US006883192B1

(12) United States Patent
Rose et al.

(10) Patent No.: US 6,883,192 B1
(45) Date of Patent: Apr. 26, 2005

(54) BED SKIRT FASTENER ASSEMBLY

(75) Inventors: Mark Rose, Dallas, TX (US); Michael W. Freitas, Colleyville, TX (US)

(73) Assignee: Style Architects, LLC, Dallas, TX (US)

( * ) Notice: Subject to any disclaimer, the term of this patent is extended or adjusted under 35 U.S.C. 154(b) by 0 days.

(21) Appl. No.: 10/809,342

(22) Filed: Mar. 26, 2004

(51) Int. Cl.[7] ..... A47G 9/04
(52) U.S. Cl. ..... 5/493; 24/72.5
(58) Field of Search ..... 5/493, 482, 496, 5/498; 24/72.5

(56) References Cited

U.S. PATENT DOCUMENTS

| | | | | |
|---|---|---|---|---|
| 2,763,875 | A | | 9/1956 | Piontkowski |
| 4,587,683 | A | | 5/1986 | Gardiner |
| 4,782,543 | A | * | 11/1988 | Hutton et al. ..... 5/658 |
| 4,796,317 | A | | 1/1989 | Kallman et al. |
| 4,897,891 | A | | 2/1990 | Kallman et al. |
| 5,086,531 | A | | 2/1992 | Carlos |
| 5,205,003 | A | | 4/1993 | Green |
| 5,335,383 | A | | 8/1994 | Schwind |
| 5,353,456 | A | | 10/1994 | Evans |
| 5,483,712 | A | | 1/1996 | Greenwood |
| 5,621,931 | A | | 4/1997 | Hamilton |
| 6,035,469 | A | | 3/2000 | Schrougham |
| 6,151,731 | A | | 11/2000 | Saparow |
| 6,276,009 | B1 | | 8/2001 | Schrougham |

* cited by examiner

*Primary Examiner*—Alexander Grosz
(74) *Attorney, Agent, or Firm*—Locke Liddell & Sapp LLP

(57) ABSTRACT

A mounting bracket for positioning a bed skirt adjacent a bed includes a support member adapted to be inserted between the top of a box spring and the bottom of a mattress. A frame is attached to the support member for mounting a fastener member. The fastener member is moveable to positions between the top of the mattress and the bottom of the box spring and mates with a fastener on the bed skirt.

7 Claims, 3 Drawing Sheets

BED SKIRT FASTENER ASSEMBLY

TECHNICAL FIELD OF THE INVENTION

The present invention relates to bed skirts, and more particularly to a bed skirt fastener assembly for allowing easy adjustment of the drop of the bed skirt to match the height of a bed.

BACKGROUND OF THE INVENTION

Bed skirts for beds, also sometimes called dust ruffles, have traditionally been permanently assembled in one piece consisting of a flat sheeting material placed between the box spring and mattress, and skirting material permanently attached to the flat sheeting material. This arrangement generally requires the removal of the mattress in order to properly place and align the flat sheet and permanently attached skirting material, and then to replacement and adjustment of the mattress on top of the box spring without disturbing the bed skirt assembly. If the skirting becomes soiled, the mattress must be removed in order to access the skirt for cleaning.

A need has thus arisen for a bed skirt fastener that is easily positionable on a bed, and which provides adjustability of the drop to match the height of the bed.

In accordance with the present invention, a mounting bracket for positioning a bed skirt adjacent a bed is provided. The bracket includes a support member adapted to be inserted between the top of a box spring and the bottom of a mattress. A frame is attached to the support member for mounting a fastener member. The fastener member mates with a fastener on the bed skirt, such that the fastener member is moveable to positions between the top of the mattress and the bottom of the box spring.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
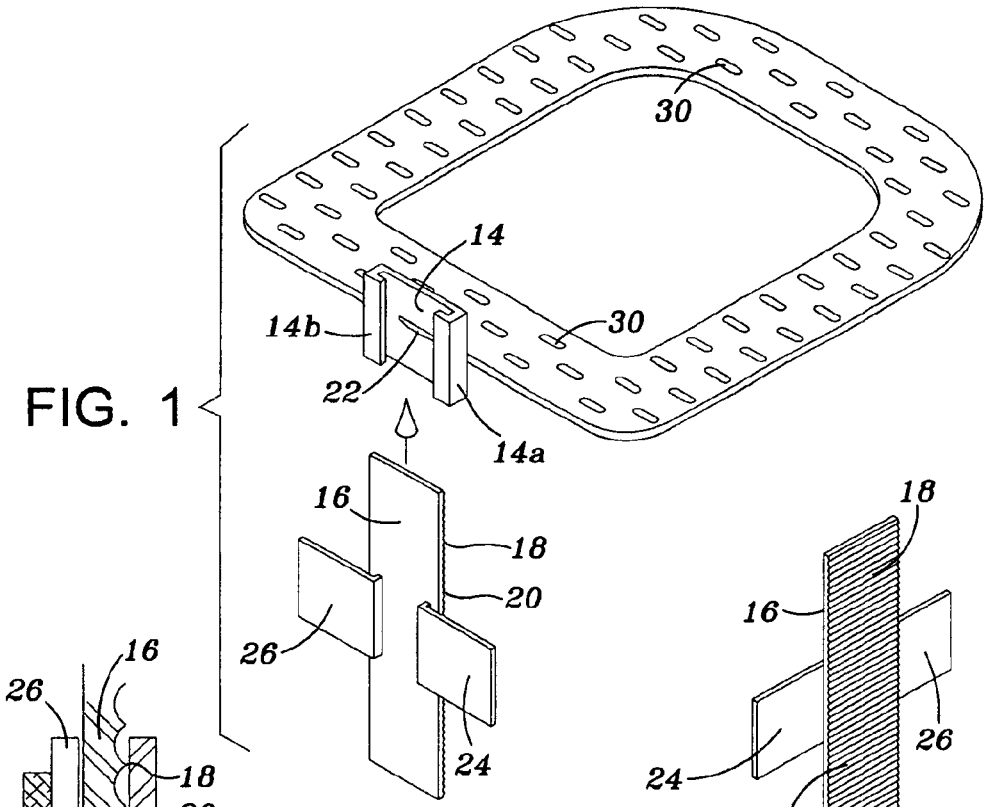
FIG. 1 is an exploded perspective view of the present mounting bracket including a fastener member in accordance with the present invention.
Figure 2:
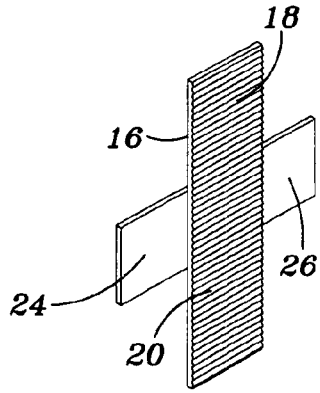
FIG. 2 is a perspective view of the present fastener member illustrated in FIG. 1 removed from the mounting bracket.
Figure 4:
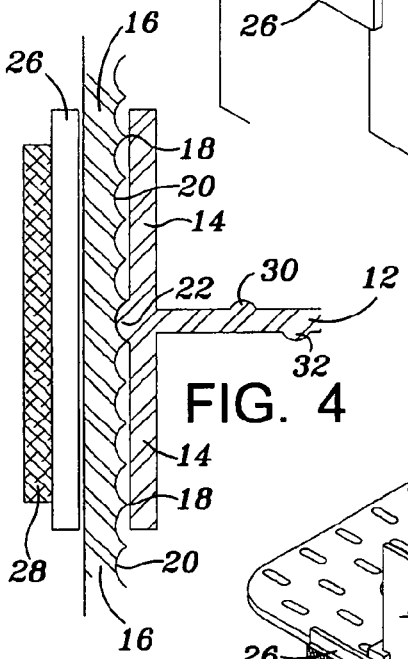
FIG. 4 is a sectional view taken generally along sectional lines 4—4 of FIG. 3.
Figure 3:
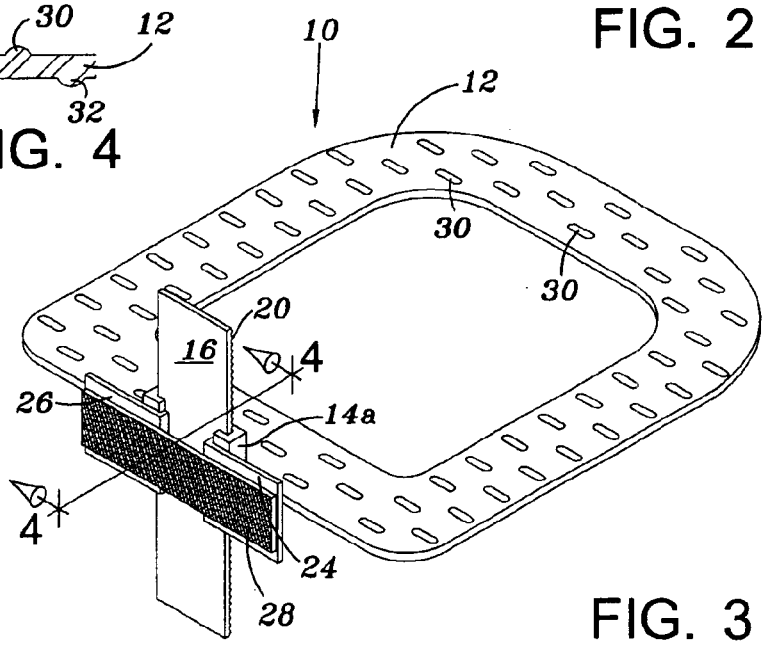
FIG. 3 is a perspective view of the present mounting bracket shown in FIG. 1.

Referring simultaneously to FIGS. 1–4, the present mounting bracket for positioning a bed skirt adjacent a bed is illustrated, and is generally identified by the numeral 10. Mounting bracket 10 includes a support member 12 which is adapted to be inserted between the top of a box spring and the bottom of a mattress. Support member 12 includes a frame 14 including a track 14*a* and 14*b*. Track 14*a* and 14*b* of frame 14 mount a fastener member 16. As illustrated in FIG. 3, fastener member 16 mounts within track 14*a* and 14*b* of frame 14 for slideable movement therein.

Fastener member 16 comprises a rack or ratchet having a plurality of spaced apart teeth 18 and spaced apart grooves 20. Grooves 20 and teeth 18 engage a detent 22 disposed within frame 14 for maintaining fastener member 16 in a predetermined position within frame 14. Fastener member 16 is slideable within frame 14 to positions above and below support member 12.

Fastener member 16 includes attachment members 24 and 26. Attachment members 24 and 26 receive a fastener 28. Fastener 28 may comprise, for example, a hook and loop style fastener, which may be adhesively adhered to attachment members 24 and 26. Hook and loop style fastener 28 is shown for illustrative purposes only, it being understood that numerous other types of fasteners may be attached to attachment members 24 and 26 in accordance with the present invention.

Attachment members 24 and 26 mount fastener 28 to fastener member 16 such that fastener member 16 can position fastener 28 above and below support member 12 by selectively engaging ones of teeth 18 and a groove 20 with detent 22.

Support member 12 includes projections 30 and 32 (FIG. 4) to provide additional frictional engagement between support member 12 and a mattress and box spring, respectively.

Figure 5:
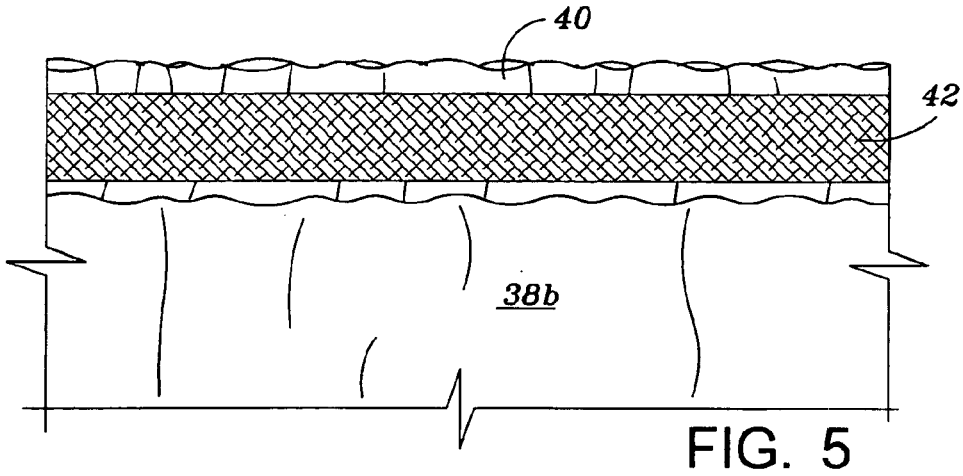
FIG. 5 is a rear elevational view of a bed skirt.

FIG. 5 illustrates the back 38*b* of a bed skirt 40. Attached to back 38*b* of bed skirt 40 is a fastener 42 in the form of hook and loop style fasteners which is attached to bed skirt 40 using adhesive or other fasteners. The present bed skirt fastener assembly includes a plurality of mounting brackets 10 and a bed skirt 40 having fasteners, such as, for example, fasteners 42. It is understood that other types of fasteners may be attached to the back 38*b* of a bed skirt 40, and fastener 42 is shown for illustrative purposes only. Fasteners 28 and 42 may also include, for example, a hook and ring.

Figure 6:
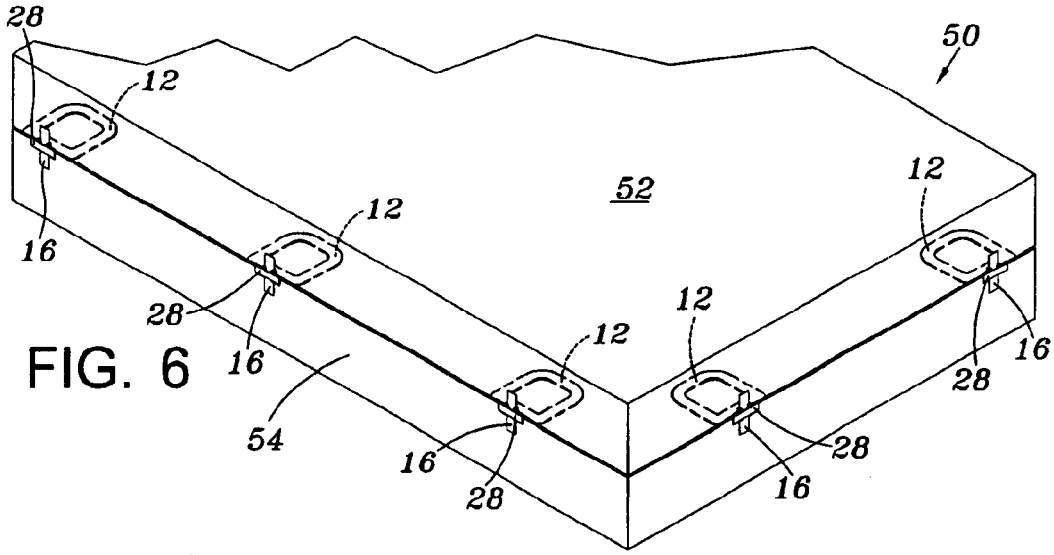
FIG. 6 is a perspective view of a portion of a box spring and mattress combination illustrating placement of the present mounting bracket.
Figure 7:
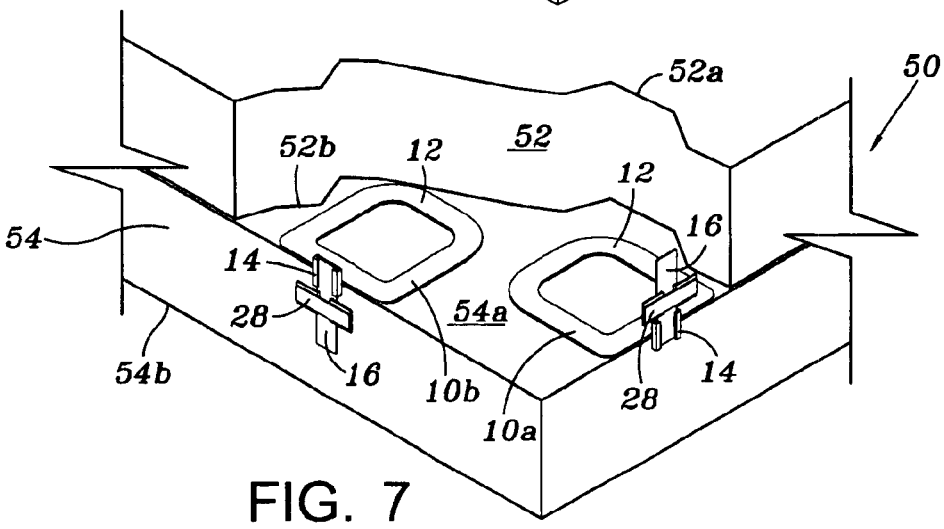
FIG. 7 is a perspective view of a portion of a box spring and mattress combination illustrating an additional use of the present mounting bracket.

Referring simultaneously to FIGS. 6 and 7, a bed 50 is illustrated. Bed 50 includes a mattress 52 supported on a box spring 54. Bed 50 is supported in a frame (not shown) for supporting bed 50 above a floor. Mattress 52 includes a top 52*a* and bottom 52*b*. Box spring 54 includes a top 54*a* and bottom 54*b*.

Mounting bracket 10 is adapted to be inserted between mattress 52 and box spring 54, such that support member 12 contacts bottom 52*b* of mattress 52 and top 54*a* of box spring 54. Frame 14 is positioned adjacent to mattress 52 and box spring 54. Support member 12 is frictionally held between mattress 52 and box spring 54 without the use of additional attachment devices.

In order to attach a bed skirt 40 adjacent to bed 50, a plurality of mounting brackets 10 are utilized, and are disposed around the circumference of bed 50. The number of mounting brackets 10 required to attach a bed skirt 40 adjacent to bed 50 is determined by, such as, for example, the weight of bed skirt 40, fabric type of bed skirt 40, and size of bed 50. In order to mount bed skirt 40 to mounting brackets 10, fastener 42 of bed skirt 40 is attached to fastener 28 disposed on fastener member 16. Fastener member 16 is then slid within track 14*a* and 14*b* of frame 14 to a position based upon the drop of the bed skirt 40 so that the bottom of bed skirt 40 lies adjacent to the floor supporting bed 50. The plurality of grooves 20 and teeth 18 in fastener member 16 allow for the vertical height adjustment of bed skirt 40. The position of bed skirt 40 with respect to box spring 54 and the height of box spring 54 off the supporting floor is determined by which pair of teeth 18 and groove 20 engage detent 22. It therefore can be seen that the present mounting bracket accommodates bed skirts having variable height dimensions, length dimensions and beds positioned above a floor by variable amounts.

Referring to FIG. 7, in instances where the height of bed skirt 40 is relatively large or where bed 50 is supported in a frame relatively close to the supporting floor, mounting brackets 10 are mounted to a bed 50, such that fastener member 16 is disposed adjacent to mattress 52 as illustrated in FIG. 7, showing the position of mounting bracket 10*a* instead of being positioned adjacent to box spring 54 in the position of mounting bracket 10*b*. In this manner, bed skirt 40 having a longer drop can be attached to a fastener member 16 which is positioned above top surface 54*a* of box spring 54.

Figure 8:
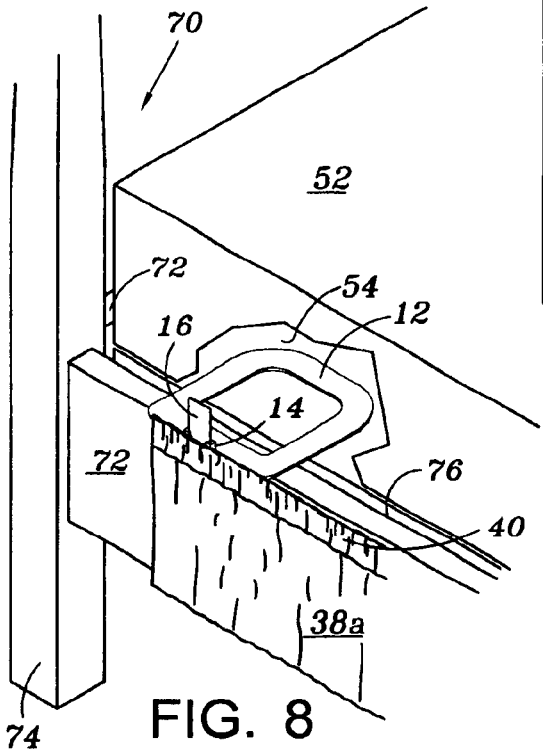
FIG. 8 is perspective view of a portion of a box spring and mattress combination including a bed frame illustrating a use of the present mounting bracket.

Referring to FIG. 8, bed 50 is illustrated as being mounted to a frame, generally identified by the numeral 70 having rails 72 and bed post 74. Mounting bracket 10 allows for the positioning of a bed skirt 40 adjacent to rail 72 in a manner previously described. By positioning support member 12 such that frame 14 is positioned adjacent to rail 72, a horizontal accommodation is made by mounting bracket 10, such that supporting member 12 bridges the gap 76 between bed 50 and rail 72 of frame 70.

Figure 9:
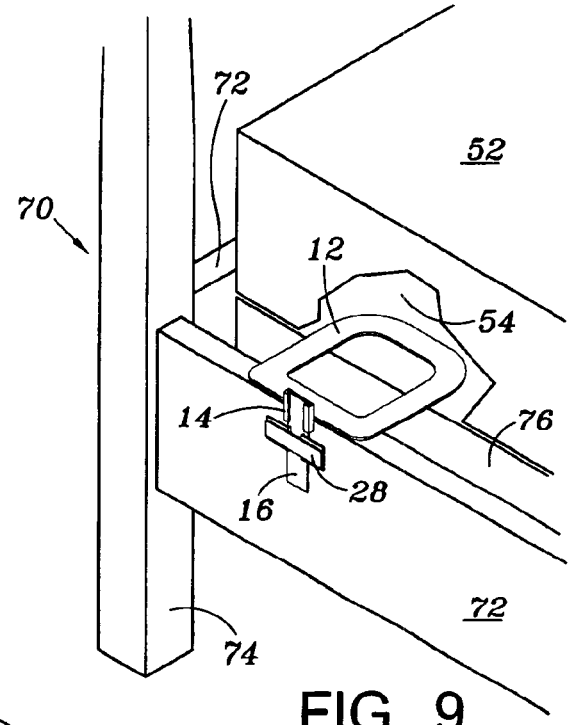
FIG. 9 is a perspective view of a portion of a box spring and mattress combination including a bed frame illustrating a further use of the present mounting bracket.

FIG. 9 illustrates bed 50 positioned within frame 70 where gap 76 is greater that illustrated in FIG. 8. Where frame 70 positions bed 50 close to the floor or for a bed skirt 40 having a large height, bed skirt 40 can be mounted to fastener member 16 in a higher position than illustrated in FIG. 8 to provide the desired drop.

Figure 10:
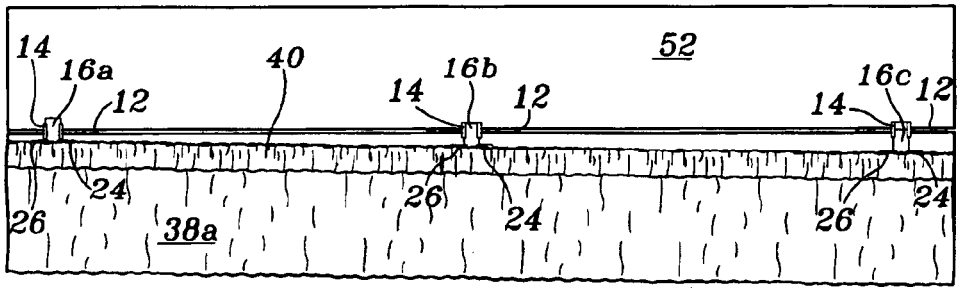
FIG. 10 is a front elevational view of a box spring and mattress combination illustrating the use of the present mounting bracket where a bed is supported on a non-level surface.

FIG. 10 illustrates the use of the present mounting bracket 10 for vertically adjusting the drop of a bed skirt 40 at multiple vertical heights along a bed 50 in the instance where bed 50 is supported on a floor having a slope. In this manner, bed skirt 40 can be aligned with the slope of the floor so that there is no gap between bed skirt 40 and the floor. As illustrated in FIG. 10, a supporting floor for bed 50 slopes from left to right in a downward fashion such that bed skirt 40 is supported further from the floor by fastener member 16*a* and closer to floor by fastener member 16*c*, and supported between those two positions by fastener member 16*b*. Each fastener member 16*a*, 16*b* and 16*c*, allows bed skirt 40 to be independently positioned along the length of bed skirt 40 with respect to box spring 54.

The present invention provides for a bed skirt fastener assembly in which the bed skirt may be continuous for positioning along a bed or where a bed skirt is fabricated in segments or in panels where bed skirts would be separately mounted to a bed along the bed sides and the bed foot.

Other alteration and modification of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed:

1. A mounting bracket for positioning a bed skirt adjacent a bed, the bed having a box spring which supports a mattress, the box spring having a top and bottom and the mattress having a top and bottom, the mounting bracket comprising:

a support member adapted to be inserted between the top of the box spring and the bottom of the mattress;

a fastener member adapted to be attached to the bed skirt;

a frame attached to said support member for mounting said fastener member, such that said fastener member is moveable to positions between the top of the mattress and the bottom of the box spring;

a detent disposed on said frame;

a rack having a plurality of spaced apart teeth, said rack being slidably mounted in said frame, such that ones of said teeth engage said detent for maintaining said rack in a predetermined position within said frame; and a fastener attached to said rack and adapted to be attached to the bed skirt.

2. The mounting bracket of claim 1 wherein said rack is adapted to be disposed adjacent the box spring to thereby mount the bed skirt between the top and bottom of the box spring.

3. The mounting bracket of claim 1 wherein said rack is adapted to be disposed adjacent the mattress, to thereby mount the bed skirt between the top and bottom of the mattress.

4. A bed skirt assembly for use with a bed, the bed having a box spring which supports a mattress, the box spring having a top and bottom and a circumference and the mattress having a top and bottom and a circumference, the assembly comprising:

a bed skirt having a fastener;

a plurality of mounting brackets, each of said mounting brackets including a fastener member and a support member, said support member adapted to be inserted between the top of the box spring and the bottom of the mattress;

each of said mounting brackets further including a frame attached to said support member for mounting said fastener member, said fastener member including a fastener for attaching to said bed skirt fastener;

said fastener member being moveable to positions between the top of the mattress and the bottom of the box spring; and said plurality of brackets being selectively postionable, such that said bed skirt is mounted around the circumference of the box spring and the mattress.

5. The mounting bracket of claim 4, wherein each of said frames includes:

a detent disposed on said frame;

a rack having a plurality of spaced apart teeth, said rack being slidably mounted in said frame, such that ones of said teeth engage said detent for maintaining said rack in a predetermined position within said frame; and a fastener attached to said rack and adapted to be attached to the bed skirt.

6. The assembly of claim 4 wherein said fastener member is adapted to be disposed adjacent the box spring to thereby mount said bed skirt between the top and bottom of the box spring.

7. The assembly of claim 4 wherein said fastener member is adapted to be disposed adjacent the mattress, to thereby mount said bed spring between the top and bottom of the mattress.

* * * * *